US012342909B1

(12) United States Patent
Peng

(10) Patent No.: US 12,342,909 B1
(45) Date of Patent: Jul. 1, 2025

(54) BELT

(71) Applicant: MLB DIRECT INC, Wilmington, DE (US)

(72) Inventor: Weiping Peng, Shenzhen (CN)

(73) Assignee: MLB DIRECT INC, Wilmington, DE (US)

( * ) Notice: Subject to any disclaimer, the term of this patent is extended or adjusted under 35 U.S.C. 154(b) by 0 days.

(21) Appl. No.: 18/783,363

(22) Filed: Jul. 24, 2024

(51) Int. Cl.
*A44C 5/00* (2006.01)
*A41F 9/00* (2006.01)
*A44B 11/20* (2006.01)

(52) U.S. Cl.
CPC ..... *A44B 11/20* (2013.01); *A41F 9/00* (2013.01)

(58) Field of Classification Search
CPC . A44B 11/20; A41F 9/00; A41F 9/002; A41F 11/00; A41F 11/16; A41F 9/02; A41F 11/14; A41F 11/02; A41D 2200/10
USPC ..... 24/198
See application file for complete search history.

(56) References Cited

U.S. PATENT DOCUMENTS 1,366,852 A * 1/1921 Von Rentsch ..... A41F 9/00 2/236
1,841,375 A * 1/1932 Meyer ..... A44C 5/0092 63/3
2,173,469 A * 9/1939 Bennett ..... A41F 9/00 2/221
2,367,091 A * 1/1945 Bloth ..... G04B 37/005 968/300
2,532,161 A * 11/1950 Gomberg ..... A44C 5/145 63/3
2,649,230 A * 8/1953 Thompson ..... G04B 37/005 368/286
2,895,658 A * 7/1959 Dzus ..... A44C 5/00 224/171
3,427,661 A * 2/1969 Navasky ..... A41F 9/00 2/220
3,610,488 A * 10/1971 Tracy ..... A44C 5/00 224/171
4,060,185 A * 11/1977 Kuroda ..... A44C 5/147 63/11
5,762,241 A * 6/1998 Cross ..... A44C 5/0053 224/178
5,812,500 A * 9/1998 Webb, Jr. ..... G04B 37/005 368/282
5,838,642 A * 11/1998 Tully ..... A41D 20/00 368/286
6,199,730 B1 * 3/2001 Chisolm ..... A44C 5/0053 224/166
6,449,774 B1 * 9/2002 Michael ..... G09F 21/02 2/311
8,870,448 B2 * 10/2014 Bianco ..... A44C 5/00 224/174
9,775,413 B1 * 10/2017 Ingimundarson ..... A45F 5/00
10,463,118 B1 * 11/2019 Qin ..... A44C 5/2071
(Continued)

*Primary Examiner* — Jason W San
*Assistant Examiner* — Anna S Rashid
(74) *Attorney, Agent, or Firm* — Jose Cherson Weissbrot

(57) ABSTRACT

A belt, including: a buckle, provided with a movable lock catch thereon; and a belt body, with the buckle provided at an end of the belt body, where a bottom surface of the belt body is woven with a plurality of raised ridges, and the raised ridges on the bottom surface of the belt body are arranged at intervals; and the lock catch is capable of being held in any spacing region between adjacent raised ridges, so as to adjust the tension of the belt.

18 Claims, 3 Drawing Sheets

(56) References Cited

U.S. PATENT DOCUMENTS

| | | | | |
|---|---|---|---|---|
| 10,736,386 | B1 * | 8/2020 | Hutchins | A44C 15/0025 |
| 11,540,597 | B1 * | 1/2023 | Rowland | A44B 11/20 |
| 11,937,671 | B2 * | 3/2024 | Crowley | A44C 5/0084 |
| 11,980,244 | B1 * | 5/2024 | Phung | A41F 9/002 |
| 12,004,610 | B1 * | 6/2024 | Zhang | A44C 5/0053 |
| 2005/0262618 | A1 * | 12/2005 | Musal | A42B 3/145 2/417 |
| 2008/0134480 | A1 * | 6/2008 | Shiue | A44B 11/20 24/68 E |
| 2012/0260392 | A1 * | 10/2012 | Votel | A41D 13/065 2/24 |
| 2015/0082662 | A1 * | 3/2015 | Farris | A41F 9/002 2/322 |
| 2019/0380414 | A1 * | 12/2019 | Hinds | A42C 5/02 |
| 2020/0323316 | A1 * | 10/2020 | Lui | A44C 5/0053 |
| 2022/0338580 | A1 * | 10/2022 | Stockinger | A41F 9/00 |
| 2024/0032616 | A1 * | 2/2024 | Goldschmidt | A41C 3/144 |
| 2024/0206602 | A1 * | 6/2024 | Borisen | A44C 5/0053 |
| 2024/0335012 | A1 * | 10/2024 | Chen | A44C 5/14 |

* cited by examiner

BELT

TECHNICAL FIELD

The present disclosure relates to the field of belts, and in particular to a belt.

BACKGROUND

Belts are one of the most common apparel accessories. The belt serves to tighten the trousers, and can also play a decorative role. The belt generally includes a buckle and a belt body, the buckle being provided at an end of the belt body, the buckle being provided with a movable lock catch, and the belt body being provided with a notch strip. When the belt is used, it is necessary to thread the belt body through the buckle and then snap the lock catch into an appropriate notch in the notch strip, thereby securing the belt body.

SUMMARY OF THE INVENTION

In order to overcome the disadvantages in the prior art, the present disclosure provides a belt, in which a lock catch on a buckle can be fitted and held without an additional notch strip.

The present disclosure is implemented by means of the following technical solution:

a belt, including: a buckle, provided with a movable lock catch thereon; and a belt body, with the buckle provided at an end of the belt body, where a bottom surface of the belt body is woven with a plurality of raised ridges, and the raised ridges on the bottom surface of the belt body are arranged at intervals; and when the other end of the belt body is inserted into the buckle, the lock catch is capable of being held in any spacing region between adjacent raised ridges, so as to adjust the tension of the belt.

In addition to the above illustrative aspects, implementations and features, further aspects, implementations and features of the present application will become readily apparent with reference to the accompanying drawings and the following detailed description.

List of reference signs: 1—buckle; 2—lock catch; 3—belt body; 4—raised ridge; 5—spacing region; 6—first woven layer; 7—second woven layer; 8—woven structure; 9—connecting thread; 10—adhesive layer; 11—supporting layer; 12—upper layer; 13—lower layer; 14—edge cover; 15—first weft group; 16—warp group; 17—second weft group.

DETAILED DESCRIPTION OF EMBODIMENTS

Specific embodiments of the present disclosure will be described in detail in this section. Preferred embodiments of the present disclosure are illustrated in the accompanying drawings. The accompanying drawings serve to supplement the text description of the specification with figures, providing a visual understanding of each technical feature and the overall technical solution of the present disclosure, but cannot be construed as a limitation to the scope of protection of the present disclosure.

In the description of the present disclosure, it should be understood that orientation or position relationships indicated by terms "upper", "lower", "front", "rear", "left", "right", etc. are orientation or position relationships as shown in the accompanying drawings, and these terms are just used to facilitate description of the present disclosure and simplify the description, rather than indicating or implying that the mentioned device or element must have a specific orientation and must be constructed and operated in a specific orientation, and thus cannot be construed as a limitation to the present disclosure.

In the description of the present disclosure, "several" means one or more, "a plurality of" means two or more, "greater than", "less than", "over", etc. are construed as excluding the number, and "above", "below", "within", etc. are construed as including the number. The terms "first" and "second" in the description are merely intended to distinguish technical features, and cannot be construed as indicating or implying relative importance or implicitly indicating the number of indicated technical features or implicitly indicating a sequence relationship between the indicated technical features.

In the description of the present disclosure, unless otherwise explicitly defined, the words such as "arrange", "mount" and "connect" should be understood in a broad sense, and those skilled in the art can reasonably determine the specific meanings of the above words in the present disclosure with reference to the specific contents of the technical solutions.

Figure 1:
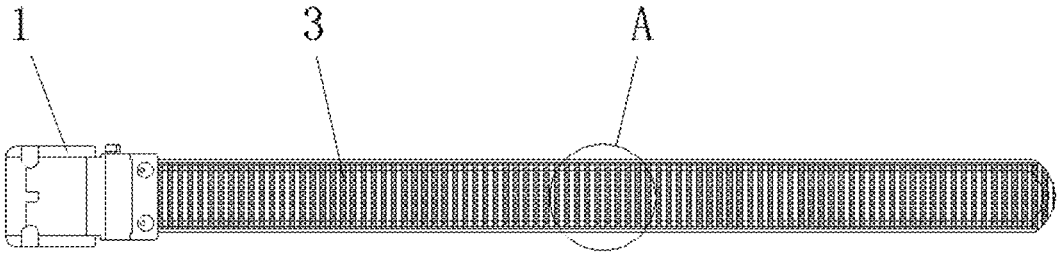
FIG. 1 is a schematic structural diagram of a belt according to an embodiment of the present disclosure.
Figure 2:
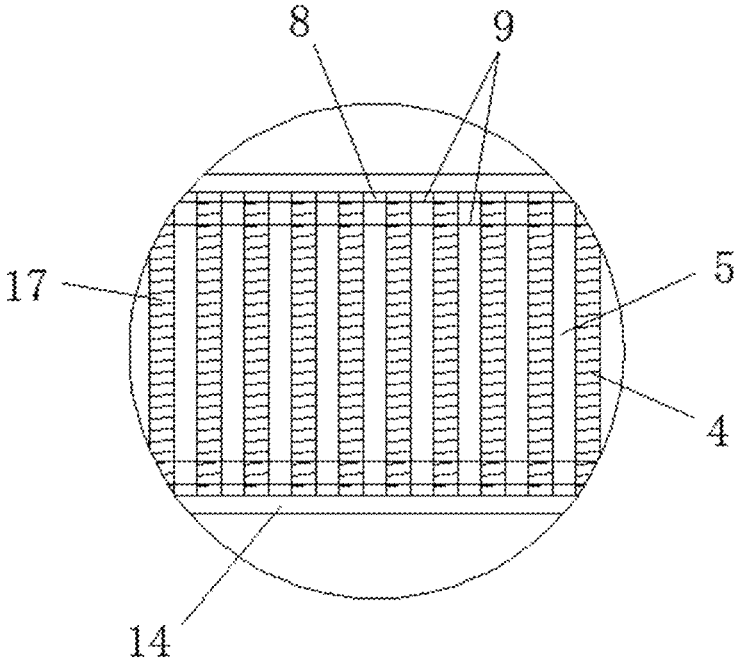
FIG. 2 is an enlarged view of part A in FIG. 1.
Figure 3:
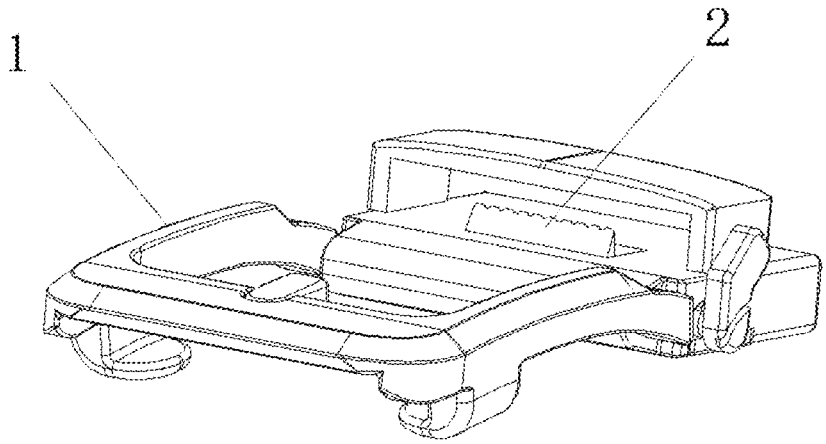
FIG. 3 is a schematic structural diagram of a buckle according to an embodiment of the present disclosure.

Referring to FIGS. 1 to 3, according to a preferred embodiment of a belt in the present disclosure, the belt includes: a buckle 1, provided with a movable lock catch 2 thereon; and a belt body 3, with the buckle 1 provided at an end of the belt body 3, where a bottom surface of the belt body 3 is woven with a plurality of raised ridges 4, and the raised ridges 4 on the bottom surface of the belt body 3 are arranged at intervals; and when the other end of the belt body 3 is inserted into the buckle 1, the lock catch 2 is capable of being held in any spacing region 5 between adjacent raised ridges 4, so as to adjust the tension of the belt.

According to the belt of the present disclosure, the bottom surface of the belt body 3 is woven with the plurality of raised ridges 4, the raised ridges 4 on the bottom surface of the belt body 3 being arranged at intervals, and when the other end of the belt body 3 is inserted into the buckle 1, the lock catch 2 is capable of being held in any spacing region 5 between adjacent raised ridges 4, so as to adjust the tension of the belt. In this way, the lock catch 2 on the buckle 1 can be fitted and held without an additional notch strip.

Figure 4:
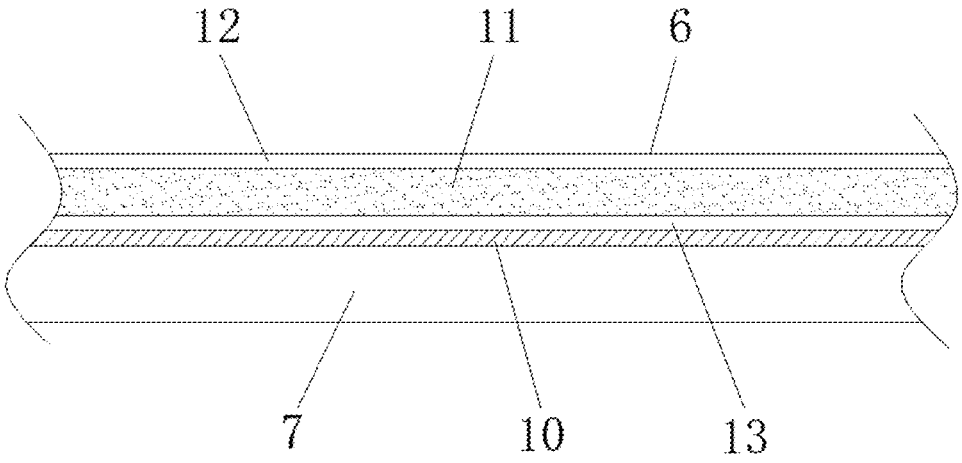
FIG. 4 is a partial schematic diagram of a structure of a cross-section of a belt according to an embodiment of the present disclosure.

Referring to FIG. 4, in an implementation, the belt body 3 includes a first woven layer 6 and a second woven layer 7, a bottom surface of the first woven layer 6 being connected to a top surface of the second woven layer 7. In this way, the strength of the belt body 3 can be increased, and the occurrence of deformation of the belt can be reduced, thereby increasing durability of the belt. In another implementation, the belt body 3 may have a single-layer structure. In another implementation, the belt body 3 may have a multi-layer structure with two or more layers. In another implementation, other material layers may be used instead of the first woven layer 6.

Referring to FIGS. 2 and 4, in an implementation, the first woven layer 6 and the second woven layer 7 are connected by means of weaving with a woven structure 8. In this way, the overall connection strength of the belt body 3 for the belt can be improved and the occurrence of detachment of the first woven layer 6 from the second woven layer 7 can be reduced, thereby increasing durability. In another implementation, the first woven layer 6 and the second woven layer 7 may be connected using other suitable structures.

In an implementation, the woven structure 8 includes at least two connecting threads 9, and each connecting thread 9 connects the first woven layer 6 and the second woven layer 7 by means of weaving around an edge of the belt body 3. For example, the number of connecting threads 9 may be two, three, four, five, six, or other appropriate numbers. In this way, when some of the connecting threads 9 are broken, there are still other connecting threads 9 connecting the first woven layer 6 and the second woven layer 7, which reduces the occurrence of detachment of the first woven layer 6 from the second woven layer 7, thereby achieving a multi-protection effect. In another implementation, there may be one connecting thread 9.

Referring to FIG. 4, in an implementation, the belt body 3 includes an adhesive layer 10, the adhesive layer 10 is disposed between the first woven layer 6 and the second woven layer 7, and the adhesive layer 10 is adhered to the first woven layer 6 and the second woven layer 7. In this way, since the first woven layer 6 and the second woven layer 7 are formed by means of weaving, surfaces of the first woven layer 6 and the second woven layer 7 have concave-convex structures, which enables more secure adhesion of the adhesive layer 10 to the first woven layer 6 and the second woven layer 7. In another implementation, the belt body 3 may not include the adhesive layer 10.

In an implementation, the belt body 3 includes a supporting layer 11, and the supporting layer 11 is disposed inside the belt body 3. The supporting layer 11 is disposed inside the belt body 3, thus the deformation resistance of the belt body 3 can be improved, so that it is easier for the belt body 3 to thread through trouser loops and the buckle 1 and the durability is increased. In another implementation, the belt body 3 may not include the supporting layer 11.

In an implementation, the supporting layer 11 is a pe adhesive sheet. The pe adhesive sheet has good hardness and flexibility, thereby achieving a good implementation effect. In another implementation, the supporting layer 11 may be made of other suitable materials.

In an implementation, the belt body 3 includes the supporting layer 11, and the supporting layer 11 is disposed inside the first woven layer 6. In this way, the strength of connection between the supporting layer 11 and the belt body 3 can be improved. In another implementation, the supporting layer 11 may be disposed inside the second woven layer 7. In another implementation, the supporting layer 11 may be disposed between the first woven layer 6 and the second woven layer 7.

In an implementation, the first woven layer 6 includes an upper layer 12 and a lower layer 13, a surface of the supporting layer 11 facing the upper layer 12 is adhesively connected to a surface of the upper layer 12 facing the supporting layer 11, and a surface of the supporting layer 11 facing the lower layer 13 is adhesively connected to a surface of the lower layer 13 facing the supporting layer 11, thereby enabling the bonding between the supporting layer 11 and the first woven layer 6 to be more secure and reliable. In another implementation, the supporting layer 11 may be disposed on the belt body 3 in other suitable manners.

Referring to FIGS. 1 and 2, in an implementation, an edge of the second woven layer 7 is woven with an edge cover 14, which is more conducive to the protection of the edge of the second woven layer 7 and enables the belt to be more durable, thereby preventing the edge of the second woven layer 7 from being worn out and causing the looseness of the second woven layer 7. In another implementation, the edge of the second woven layer 7 may be provided with no edge cover 14.

In an implementation, a length direction of each raised ridge 4 is perpendicular to a length direction of the belt body 3, so that an area of the belt body 3 can be more rationally used to arrange the raised ridges 4. In another implementation, the length direction of each raised ridge 4 may be oriented in other suitable directions.

In an implementation, the spacing region 5 between adjacent raised ridges 4 of the belt body 3 is connected to an adjacent raised ridge 4 by means of weaving, so that the overall connection strength of the belt body 3 can be improved, the occurrence of the looseness of the belt body 3 can be reduced, and the durability can be increased. In another implementation, the spacing region 5 between adjacent raised ridges 4 of the belt body 3 may be connected to the adjacent raised ridge 4 by means of other connecting structures.

In an implementation, a surface of each raised ridge is a cambered surface, thus during the use of the belt, a user feels better when touching the surfaces of the raised ridges instead of feeling uncomfortable, thereby improving the user experience. In addition, the lock catch 2 on the buckle 1 may touch the raised ridge during the adjustment of the belt, since the surface of each raised ridge is formed as a cambered surface, even if the lock catch 2 on the buckle 1 touches the raised ridge, it slides over the raised ridge easily. Therefore, the adjustment of the belt is smoother and the wear of the raised ridges can be reduced. In another implementation, the surface of each raised ridge may have other suitable shapes.

Figure 5:
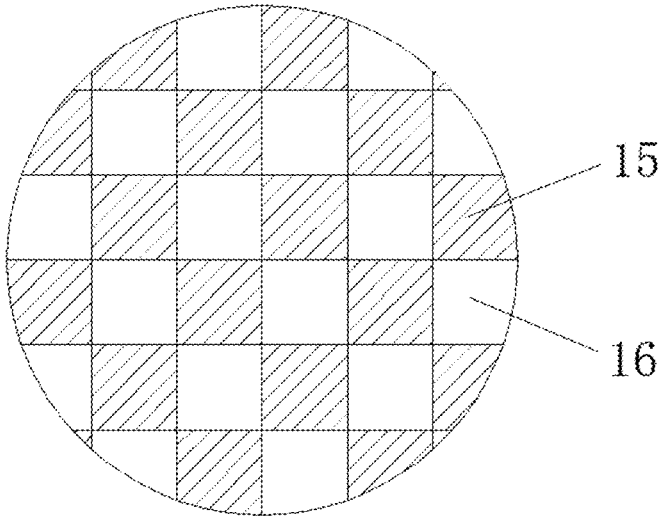
FIG. 5 is a partial schematic diagram of a woven structure of a first woven layer according to an embodiment of the present disclosure.

Referring to FIG. 5, in an implementation, the first woven layer 6 includes a plurality of second weft groups 17 and a plurality of warp groups 16, each of the second weft groups 17 and the warp groups 16 includes a plurality of yarns, and the second weft groups 17 and the warp groups 16 are woven to form a lattice texture. In this way, the structure described above is woven tightly and firmly, and is not easy to loosen. During the use of the belt, the user feels better when touching the surfaces of the raised ridges instead of feeling uncomfortable, thereby improving the user experience. In another implementation, the first woven layer 6 may be woven using other suitable structures.

Referring to FIG. 2, in an implementation, each raised ridge 4 includes a plurality of second weft groups 17. Each second weft group 17 includes a plurality of yarns. In this way, on the one hand, since each second weft group 17 includes a plurality of yarns, the strength of the raised ridge 4 can be improved. On the other hand, even if some of the yarns of the second weft group 17 are worn out, there are still other yarns to hold the connection, thereby reducing the occurrence of the looseness of the overall woven structure 8 caused by the wear of the raised ridge 4. In another implementation, each raised ridge 4 may be woven using other suitable structures.

It can be understood that the greater the weaving density, the greater the strength of the woven structure and the less likely the woven structure is to deform; and the smaller the weaving density, the smaller the strength of the woven structure and the easier the woven structure is to deform. Since adjacent raised ridges 4 need to hold the lock catch 2, the raised ridges need a great strength to block the movement of the lock catch 2. The lock catch 2 is held in the spacing region 5 between adjacent raised ridges 4 of the belt body 3, and if the spacing region 5 can properly deforms downwards to increase the depth, it is more conducive to holding the lock catch 2. Thus, in an implementation, the spacing region 5 between adjacent raised ridges 4 of the belt body 3 includes a plurality of third weft groups. Each third weft group includes a plurality of yarns. A density of the yarns of the first weft group 15 is greater than a density of the yarns of the third weft group, so that a strength of the first weft group 15 is greater than a strength of the third weft group. The lock catch 2 on the buckle 1 can be held better, and a material of the yarns of the third weft group is also saved on and the cost is reduced. In another implementation, the density of the yarns of the first weft group 15 may be less than or equal to the density of the yarns of the third weft group.

In an implementation, the number of the yarns of the first weft group 15 is greater than the number of the yarns of the third weft group, so that the strength of the first weft group 15 is greater than the strength of the third weft group. The lock catch 2 on the buckle 1 can be held better, and a material of the yarns of the third weft group is also saved on and the cost is reduced. In another implementation, the number of the yarns of the first weft group 15 may be less than or equal to the number of the yarns of the third weft group.

In an implementation, each raised ridge 4 has a width of 1 mm to 3 mm, and a specific parameter selected within the above parameter range can achieve a preferred implementation effect. In another implementation, the width of each raised ridge 4 may adopt a parameter outside the range of 1 mm to 3 mm.

In an implementation, the spacing region 5 between adjacent raised ridges 4 of the belt body 3 has a width of 1 mm to 3 mm, and a specific parameter selected within the above parameter range can achieve a preferred implementation effect. In another implementation, the width of the spacing region 5 between adjacent raised ridges 4 in the second woven layer 7 may adopt a parameter outside the range of 1 mm to 3 mm.

In an implementation, each raised ridge 4 has a protrusion height less than 2 mm, and a specific parameter selected within the above parameter range can achieve a preferred implementation effect. In another implementation, the protrusion height of each raised ridge 4 is greater than or equal to 2 mm.

In an implementation, the first woven layer 6 has a thickness of 1 mm to 3.5 mm, and a specific parameter selected within the above parameter range can achieve a preferred implementation effect. In another implementation, the thickness of the first woven layer 6 may adopt a parameter outside the range of 1 mm to 3.5 mm.

In an implementation, the second woven layer 7 has a thickness of 1 mm to 3.5 mm, and a specific parameter selected within the above parameter range can achieve a preferred implementation effect. In another implementation, the thickness of the second woven layer 7 may adopt a parameter outside the range of 1 mm to 3.5 mm.

In an implementation, the top surface of the second woven layer 7 is also woven with a plurality of raised ridges 4, and the raised ridges 4 on the top surface of the second woven layer 7 are arranged at intervals. Therefore, on the one hand, it is not necessary to distinguish between the front and back sides of the second woven layer 7 during the production of the belt, and the second woven layer 7 can be directly connected with other components, which improves the manufacturing efficiency. On the other hand, if the first woven layer 6 and the second woven layer 7 need to be adhered to each other, the structure mentioned above enables the adhesion of the first woven layer 6 to the second woven layer 7 to be more secure, thereby improving the overall connection strength of the belt. In another implementation, the top surface of the second woven layer 7 may be woven with no raised ridge 4. In another implementation, the top surface of the second woven layer 7 may be woven with other suitable structures instead of the raised ridges 4.

Those skilled in the art can freely combine and use the above additional technical features in combination with each other, provided that no conflict occurs.

The foregoing implementations are only preferred implementations of the present disclosure and cannot be used to limit the scope of protection of the present disclosure. All non-essential modifications and substitutions made by those skilled in the art on the basis of the present disclosure shall fall within the scope of protection of the present disclosure.

The invention claimed is:

1. A belt, comprising:

a buckle, provided with a movable lock catch thereon; and a belt body, with the buckle provided at an end of the belt body, wherein a bottom surface of the belt body is woven with a plurality of raised ridges, and the raised ridges on the bottom surface of the belt body are arranged at intervals; and when the other end of the belt body is inserted into the buckle, the lock catch is capable of being held in any spacing region between adjacent raised ridges, so as to adjust the tension of the belt, the weaving density of raised ridges is greater than that of the spacing region;

wherein the belt body comprises a first woven layer and a second woven layer, a bottom surface of the first woven layer being connected to a top surface of the second woven layer;

wherein the first woven layer comprises a plurality of first weft groups and a plurality of warp groups, each of the first weft groups and the warp groups comprises a plurality of yarns, and the first weft groups and the warp groups are woven to form a lattice texture.

2. The belt according to claim 1, wherein the first woven layer and the second woven layer are connected by means of weaving with a woven structure.

3. The belt according to claim 2, wherein the woven structure comprises at least two connecting threads, each of the connecting threads connecting the first woven layer and the second woven layer by means of weaving around an edge of the belt body.

4. The belt according to claim 1, wherein the belt body comprises an adhesive layer disposed between the first woven layer and the second woven layer, the adhesive layer being adhered to the first woven layer and the second woven layer.

5. The belt according to claim 1, wherein the belt body comprises a supporting layer disposed inside the belt body.

6. The belt according to claim 5, wherein the supporting layer is a pe adhesive sheet.

7. The belt according to claim 1, wherein the belt body comprises a supporting layer disposed inside the first woven layer.

8. The belt according to claim 1, wherein the belt body comprises a supporting layer disposed inside the second woven layer, or the supporting layer is disposed between the first woven layer and the second woven layer.

9. The belt according to claim 7, wherein the first woven layer comprises an upper layer and a lower layer, a surface of the supporting layer facing the upper layer is adhesively connected to a surface of the upper layer facing the supporting layer, and a surface of the supporting layer facing the lower layer is adhesively connected to a surface of the lower layer facing the supporting layer.

10. The belt according to claim 1, wherein an edge of the second woven layer is woven with an edge cover.

11. The belt according to claim 1, wherein a length direction of each of the raised ridges is perpendicular to a length direction of the belt body.

12. The belt according to claim 1, wherein the spacing region between adjacent raised ridges of the belt body is connected to an adjacent raised ridge by means of weaving.

13. The belt according to claim 1, wherein a surface of each of the raised ridges is a cambered surface.

14. The belt according to claim 1, wherein each of the raised ridges comprises a plurality of second weft groups; and each of the second weft groups comprises a plurality of yarns.

15. The belt according to claim 1, wherein each of the raised ridges has a width of 1 mm to 3 mm; and/or, the spacing region between adjacent raised ridges of the belt body has a width of 1 mm to 3 mm.

16. The belt according to claim 1, wherein each of the raised ridges has a protrusion height less than 2 mm.

17. The belt according to claim 1, wherein the first woven layer has a thickness of 1 mm to 3.5 mm; and/or, the second woven layer has a thickness of 1 mm to 3.5 mm.

18. The belt according to claim 1, wherein the top surface of the second woven layer is also woven with a plurality of raised ridges, and the raised ridges on the top surface of the second woven layer are arranged at intervals.

* * * * *